US007454852B2

(12) United States Patent
Giovalle et al.

(10) Patent No.: US 7,454,852 B2
(45) Date of Patent: Nov. 25, 2008

(54) IRONING APPLIANCE HAVING A CORD STORAGE CAVITY

(75) Inventors: Christian Giovalle, Moidieu-Detourbe (FR); Christophe Turck, Pierre Benite (FR)

(73) Assignee: SEB, S.A., Ecully (FR)

( * ) Notice: Subject to any disclaimer, the term of this patent is extended or adjusted under 35 U.S.C. 154(b) by 0 days.

(21) Appl. No.: 11/851,067

(22) Filed: Sep. 6, 2007

(65) Prior Publication Data

US 2008/0052971 A1 Mar. 6, 2008

(30) Foreign Application Priority Data

Sep. 6, 2006 (FR) ..... 06 07812

(51) Int. Cl.
*D06F 75/40* (2006.01)
*F16L 3/01* (2006.01)

(52) U.S. Cl. ..... 38/142; 248/52

(58) Field of Classification Search ..... 38/142, 38/77.3, 77.6, 79, 88, 96; 248/51, 52; 174/158 R, 174/68.1; 24/122.3, 115 R; 68/222; D32/68, D32/73; 439/207; 74/502.5
See application file for complete search history.

(56) References Cited

U.S. PATENT DOCUMENTS 1,633,568 A * 6/1927 Brewer ..... 422/305
1,719,766 A * 7/1929 Hopkins ..... 248/52
2,439,004 A * 4/1948 Hurley ..... 38/142
2,514,400 A * 7/1950 Larkins ..... 248/117.7
2,536,776 A * 1/1951 Smellie ..... 99/385
3,717,319 A * 2/1973 Schultz et al. ..... 248/49
D312,521 S * 11/1990 Vildosola ..... D32/73
5,371,960 A * 12/1994 Wilson et al. ..... 38/77.3
5,609,047 A * 3/1997 Hellman et al. ..... 68/222
D464,875 S * 10/2002 Koppang ..... D9/711
7,062,870 B1 * 6/2006 You ..... 38/88
7,168,973 B2 * 1/2007 Wascow et al. ..... 439/373
2004/0144140 A1 7/2004 Lee

FOREIGN PATENT DOCUMENTS

EP 0431919 A2 6/1991
EP 1038821 A 9/2000
EP 1207339 A2 5/2002
EP 1207339 A3 5/2002

* cited by examiner

*Primary Examiner*—Ismael Izaguirre
(74) *Attorney, Agent, or Firm*—Browdy and Neimark, P.L.L.C.

(57) ABSTRACT

An apparatus composed of: a steam generating base delimited by a periphery; a fabric smoothing appliance; and a cord connecting the base to the appliance, the cord having a length, a transverse width and a transverse height, the base being provided with a cavity for storing the cord, the cavity having an elongated form and extending in length along the periphery of the base, and the cavity being provided with at least one opening for the introduction of the cord into the cavity. The cavity is defined by a sheath extending in length as a prolongation of the opening for receiving the cord, and the cavity has a transverse cross section adapted to permit passage and maintenance of the cord in the form of a single loop extending along the length of the cavity.

16 Claims, 2 Drawing Sheets

IRONING APPLIANCE HAVING A CORD STORAGE CAVITY

BACKGROUND OF THE INVENTION

The present relates to an apparatus having a steam generating base connected by a cord to a fabric smoothing appliance, such as a pressing iron or a wrinkle removal brush and relates more particularly to an ironing appliance in which the base has a cavity for storage of the cord.

The patent document EP 1 038 821, the disclosure of which is incorporated herein by reference, discloses a pressing appliance having a steam generating base connected by a cord to a pressing iron, this cord being mounted on an automatic reel permitting it to be stored in a cavity in the base when the pressing appliance is not being used.

Such a storage device for the cord presents the advantage that the cord connecting the iron to the base is not dragged around the appliance and does not become inadvertently caught, with the risk of causing the appliance to fall. However, such a device for storing a cord on a reel presents the drawback of being relatively complex and costly to manufacture.

BRIEF SUMMARY OF THE INVENTION

Thus, the present invention provides an apparatus having a cord storage cavity assuring the transmission of steam and/or electricity from the base to a fabric smoothing appliance, such as a pressing iron or wrinkle removal brush, which takes up little room and assures a good maintenance of the cord while being simple and economical to manufacture.

The present invention also provides a storage cavity that equally assures a good protection of the cord.

More specifically, the invention provides a pressing appliance having a steam generating base connected by a cord to a fabric smoothing appliance, such as a pressing iron or a wrinkle removal, or smoothing, brush, the base having a cord storage cavity provided with an opening for the introduction of the cord, wherein the cavity has an elongated form and extends in length along the periphery of the base.

Such an arrangement has the advantage of limiting the space occupied by the cavity in the base and permitting the provision of a compact base. Such a characteristic also permits the bending, or folding, stresses on the cord to be limited, and thus reduces the wear experienced by the cord.

According to another characteristic of the invention, the cavity extends in length over at least one quarter of the periphery of the base.

According to another characteristic of the invention, the cavity has a transverse cross section adapted to permit passage and maintenance of the cord in the form of a single loop extending along the length of the cavity.

Such a characteristic presents the advantage of assuring a good maintenance of the cord in the cavity while limiting the number of bends in the cord, the loop of the cord being introduced progressively through the opening into the cavity. Thus, this reduces the risk of premature wear of the cord due to being folded over.

According to another characteristic of the invention, the cavity has an opening at each of its longitudinal ends.

According to yet another characteristic of the invention, the transverse cross section of the cavity has a width slightly greater than the width of the cord.

According to another characteristic of the invention, the transverse cross section of the cavity has a width that is less than two times the width of the cord.

According to another characteristic of the invention, the transverse cross section of the cavity has a height greater than two times the transverse dimension, or height, of the cord in the same direction.

According to another characteristic of the invention, the cross section of the passage in the cavity is substantially constant over all of its length and substantially equal to the cross section of the opening.

According to another characteristic of the invention, the cavity has the form of a sheath extending in length as a prolongation of the opening for receiving the cord.

According to still another characteristic of the invention, the sheath projects laterally from the base.

According to another characteristic of the invention, the opening opens tangentially to one side of the base.

BRIEF DESCRIPTION OF THE DRAWING

The present invention will be better understood from the following description of a particular embodiment thereof, given by way of non-limiting example, with reference to the attached drawings in which.

DETAILED DESCRIPTION OF THE INVENTION

Figure 1:
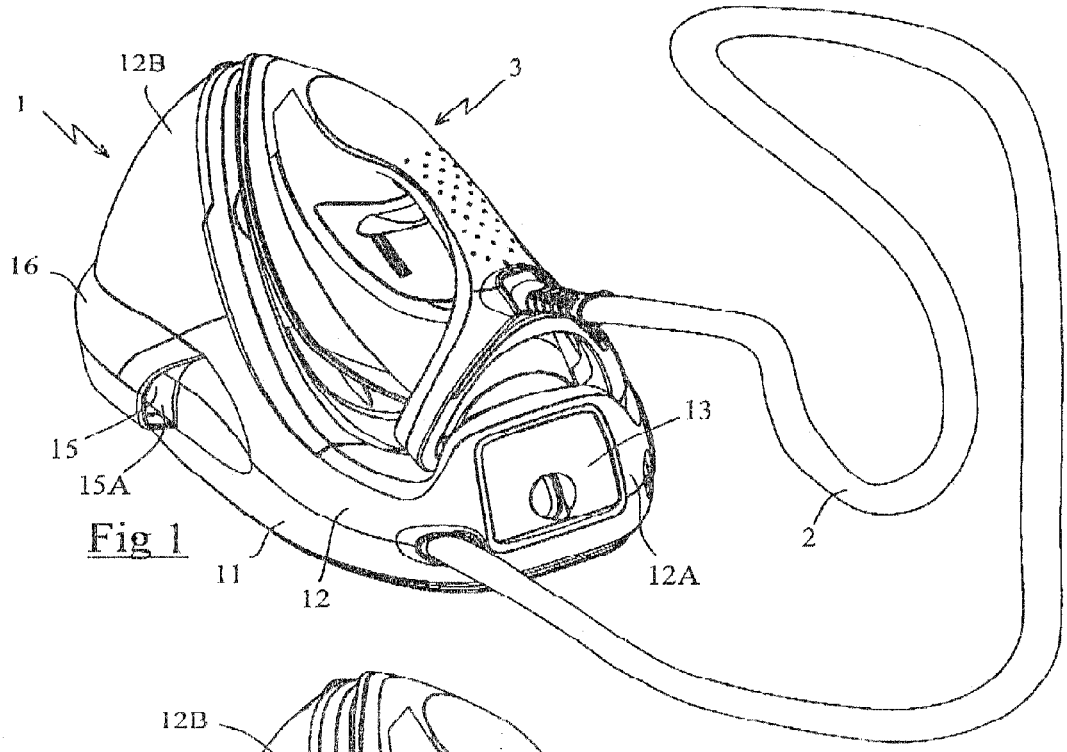
FIG. 1 is a perspective view if an apparatus according to a particular embodiment of the invention, with a cord being removed from the storage cavity.

Only the elements necessary for an understanding of the invention have been illustrated. To facilitate consideration of the drawings, the same elements are provided with the same reference numerals from one figure to another.

FIGS. 1-4 show a pressing, or smoothing, apparatus having a base 1 enclosing, in a conventional manner, a tank for generating steam under pressure, this tank being connected by a cord 2 to a steam iron 3 having an ironing soleplate.

Cord 2 connecting base 1 to pressing iron 3 has a substantially oblong cross section and encloses a conduit for conveying steam, as well as electric wires for supplying electric power to a heating resistor that is in conductive thermal communication with the soleplate. By way of example, cord two has a length of the order of 150 cm and a transverse cross section having a width of the order of 8 mm and a height of the order of 14.5 mm. Base 1 of the pressing appliance has a lower shell 11 defining the bottom, or lower part, of the base and an upper shell 12 defining the upper part of the base. Upper shell 12 has a first part 12A, preferably of opaque plastic, providing an inclined planar surface on which the iron can rest during periods of inactivity, as well as a control panel 13 provided at the front of the base.

Figure 3:
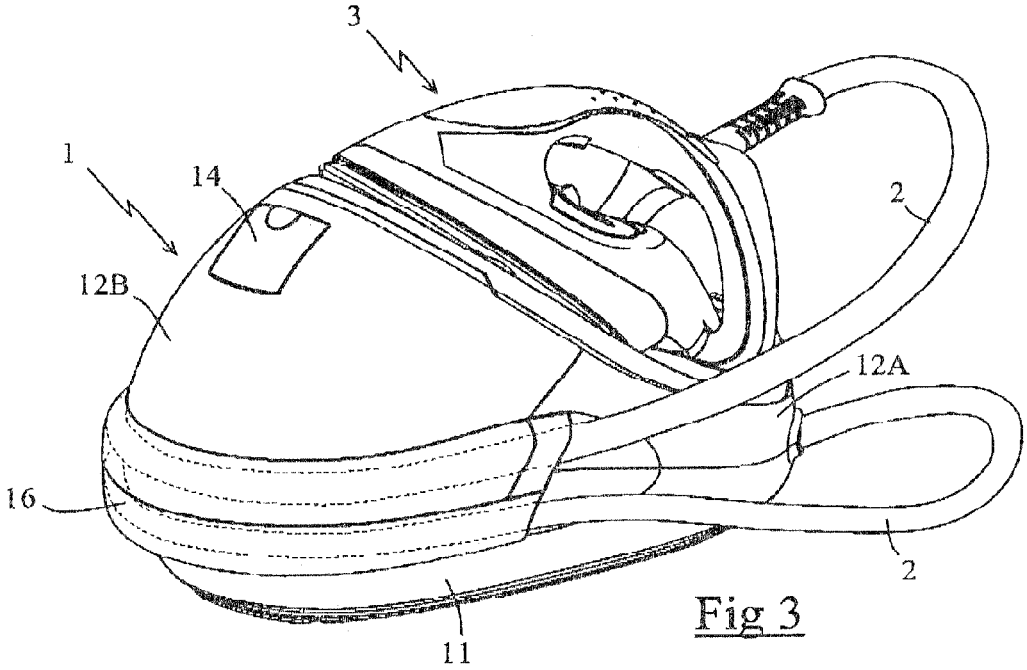

As shown in FIG. 3, upper shell 12 also has a second part 12B, preferably of translucent plastic, defining, in particular, the outer wall of a reservoir disposed at the rear of the base. This reservoir is provided with a door 14 covering a filling orifice. The reservoir is further connected to a pump (not shown) for supplying water to the tank for generating steam under pressure.

Figure 4:
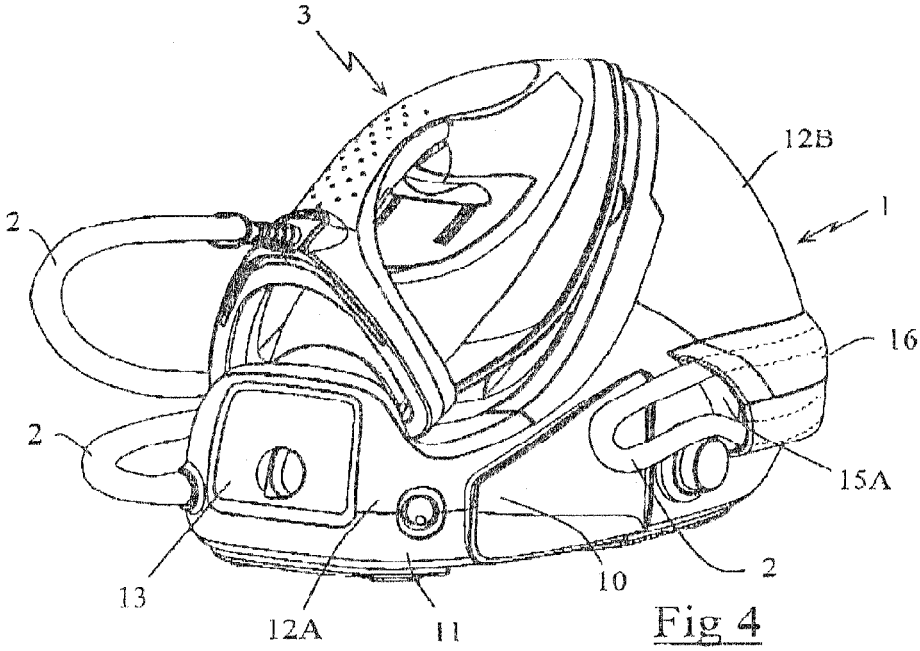

Base 2 is supplied electrically be a separate electric cable, or cord, not shown in the drawings and is provided, in a manner known per se, with housing 10 for storage of the electric cable, or cord, which housing can be seen in FIG. 4, disposed in base 1 and having a large opening through which the electric supply cord for the base of the appliance can be introduced in a bunched form.

More particularly, according to the invention, base 1 has a cavity 15 presenting an elongated form and extending, in its length dimension, along the periphery of base 1. This cavity permits storage and maintenance of cord 2 disposed in the form of a loop, or buckle, with one bend, and having a substantial length. The cavity 15 has an opening 15A into which the loop of cord 2, obtained by folding the cord in two, is progressively introduced.

Cavity 15 has a transverse cross section with a reduced width so that cord 2 is guided by the walls of the cavity, so as to prevent twisting of cord 2. Thus, cord 2 retains its configuration in the form of an elongated loop.

By way of example, the transverse cross section of cavity 15 has a width of the order 1.5 cm and a height of the order 4.5 cm. With respect to the orientation of the appliance shown in the drawings, the width is in the horizontal direction and the height is in the vertical direction.

Figure 2:
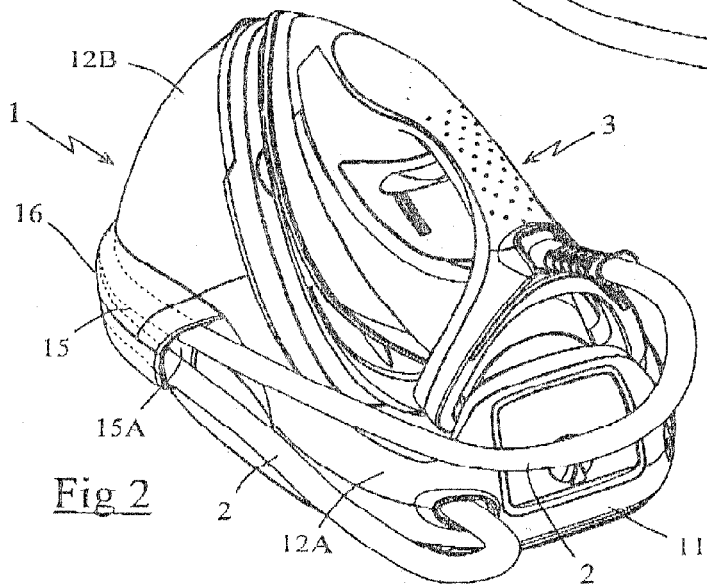
FIGS. 2-4 are various perspective views of the appliance of FIG. 1, with the cord stored in the storage cavity.

As shown in FIGS. 2-4, the lengthwise dimension of cavity 15 extends as a prolongation of opening 15A and is delimited by walls forming a sheath 18 and projecting from, and curving around the rear part of base 1 over slightly more than one-third the periphery of base 1.

In the example illustrated, sheath 16 is defined, in its upper half, by translucent second part 12B of upper shell 12 so that the position of cord 2 in cavity 15 can be observed.

In an advantageous manner, sheath 16 has an opening 15A at each of its ends, each opening 15A opening tangentially to the wall of base 1.

The presence of openings 15A at each end of sheath 16 presents the advantage of permitting introduction of cord 2 via either end of sheath 16.

Thus, when the user wishes to use the appliance, he withdraws cord 2 from sheath 16 by pulling on the end of cord 2 that is connected to iron 3 so that the user has available the entire length of cord 2 allowing iron 3 to be moved away from base 1.

Inversely, when the user desires to store the appliance, he folds cord 2 to form a loop, which he introduces progressively through one or the other of openings 15A of sheath 16. Cord 2, shown in broken lines within sheath 16, is then positioned with the two sides of the loop extending along the edges of cavity 15. When the extremity of the loop emerges from the other opening 15A, the user can then pull on that extremity in order to expedite the complete introduction of cord 2 into sheath 16 until there is no longer too much length of cord 2 to drag along a side of base 1.

Cord 2 is then perfectly maintained around base 1 and sheath 16 offers the advantage of protecting cord 2 over a long portion of its length.

Of course, the invention is not in any way limited to the embodiment described and illustrated herein, which has been provided only by way of example. Modifications remain possible, notably from the point of view of the construction of various elements or by substitution of equivalent elements or techniques, without departing from the framework of the resulting claims.

Thus, the length and orientation of the sheath for storing the cord can vary from one embodiment to another.

According to alternative embodiments, the storage sheath could extend around the periphery of the base, but within the outline of the base, rather than being visible at the outside of the base by projecting therefrom.

This application relates to subject matter disclosed in French Application number FR 06 07812, filed on Sep. 6, 2006, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An apparatus comprising: a steam generating base delimited by a periphery; a fabric smoothing appliance; and a cord connecting said base to said appliance, said cord having a length, a transverse width and a transverse height, said base being provided with a cavity for storing said cord, said cavity having an elongated form and extending in length along the periphery of said base, and said cavity being provided with at least one opening for the introduction of said cord into said cavity, wherein:

said cavity is defined by a sheath extending in length as a prolongation of said opening for receiving said cord; and said cavity has a transverse cross section adapted to permit passage and maintenance of said cord in the form of a single loop extending along the length of said cavity.

2. The apparatus of claim 1, wherein said cavity extends in length over at least one quarter of the periphery of said base.

3. The apparatus of claim 1, wherein said at least one opening comprises two openings, each opening being located at a respective longitudinal end of said cavity.

4. The apparatus of claim 1, wherein the transverse cross section of the cavity has a width slightly greater than the width of said cord.

5. The apparatus of claim 1, wherein the transverse cross section of said cavity has a width that is less than two times the width of said cord.

6. The apparatus of claim 1, wherein the transverse cross section of said cavity has a height greater than two times the transverse height of said cord.

7. The apparatus of claim 1, wherein the cross section of the passage in the cavity is substantially constant over all of its length and substantially equal to the cross section of said at least one opening.

8. The apparatus of claim 1, wherein said sheath projects laterally outwardly from said base.

9. The apparatus of claim 1, wherein said at least one opening opens tangentially to one side of said base.

10. The apparatus of claim 2, wherein said at least one opening comprises two openings, each opening being located at a respective longitudinal end of said cavity.

11. The apparatus of claim 10, wherein the transverse cross section of the cavity has a width slightly greater than the width of said cord.

12. The apparatus of claim 11, wherein the transverse cross section of said cavity has a width that is less than two times the width of said cord.

13. The apparatus of claim 12, wherein the transverse cross section of said cavity has a height greater than two times the transverse height of said cord.

14. The apparatus of claim 13, wherein the cross section of the passage in the cavity is substantially constant over all of its length and substantially equal to the cross section of at least one of said openings.

15. The apparatus of claim 14, wherein said sheath projects laterally outwardly from said base.

16. The apparatus of claim 15, wherein said at least one of said openings opens tangentially to one side of said base.

* * * * *